US011131189B2

(12) United States Patent
Ma et al.

(10) Patent No.: US 11,131,189 B2
(45) Date of Patent: Sep. 28, 2021

(54) UNDERGROUND SUPPORT

(71) Applicant: FCI Holdings Delaware, Inc., Wilmington, DE (US)

(72) Inventors: Kevin J. Ma, Gibsonia, PA (US); James Edward Pinkley, Aurora, CO (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 16/680,686

(22) Filed: Nov. 12, 2019

(65) Prior Publication Data

US 2020/0173280 A1 Jun. 4, 2020

Related U.S. Application Data

(60) Provisional application No. 62/772,899, filed on Nov. 29, 2018.

(51) Int. Cl.

| | |
|---|---|
| ***E21D 11/00*** | (2006.01) |
| ***E21D 11/40*** | (2006.01) |
| ***E21D 11/38*** | (2006.01) |
| ***E21D 15/502*** | (2006.01) |
| ***E21D 15/02*** | (2006.01) |

(52) U.S. Cl.

CPC ..... *E21D 15/502* (2013.01); *E21D 15/02* (2013.01)

(58) Field of Classification Search

CPC ..... E21D 15/502; E21D 15/02; E21D 11/00; E21D 11/40; E21D 11/08; E21D 11/383; E21D 11/385; E21D 11/083; F16L 55/16; E02D 29/16

See application file for complete search history.

(56) References Cited

U.S. PATENT DOCUMENTS

| | | | | |
|---|---|---|---|---|
| 852,916 A * | 5/1907 | Vandevort | E21D 11/15 | 405/151 |
| 1,043,348 A * | 11/1912 | O'Rourke | E21D 11/385 | 405/152 |
| 1,350,556 A * | 8/1920 | Meem | E21D 11/14 | 405/152 |
| 1,398,968 A * | 12/1921 | Jackson | E21D 11/102 | 249/194 |
| 1,413,729 A * | 4/1922 | Hastings | E21D 9/06 | 405/144 |
| 1,453,806 A * | 5/1923 | Nord | E04B 2/18 | 52/592.4 |

(Continued)

OTHER PUBLICATIONS

Contech Engineered Solutions, "Multi-Plate & Aluminum Structural Plate", Contech Structural Plate, 2012, West Chester, OH.

(Continued)

*Primary Examiner* — Edwin J Toledo-Duran
(74) *Attorney, Agent, or Firm* — The Webb Law Firm

(57) ABSTRACT

A underground support includes a first row of panels, and a second row of panels configured to be secured to the first series of panels to define an interior space for receiving construction aggregate or concrete. Each panel of the first row of panels and the second row of panels includes a body having a top edge, a bottom edge positioned opposite from the top edge, a left edge, and a right edge positioned opposite from the left edge, with the top edges of the panels of the first row of panels configured to abut the bottom edges of the panels of the second row of panels.

20 Claims, 9 Drawing Sheets

(56) References Cited

U.S. PATENT DOCUMENTS 1,701,817 A * 2/1929 Meier ..... E21D 11/00 285/398
1,983,772 A * 12/1934 Pierson ..... E02B 3/123 405/20
2,015,102 A * 9/1935 Doig ..... E21D 11/15 405/152
2,196,874 A * 4/1940 Ruegg ..... B28B 3/003 425/85
2,208,302 A * 7/1940 Fernandez ..... E21D 11/10 405/153
3,145,502 A * 8/1964 Rubenstein ..... B28B 11/04 52/223.7
3,861,154 A * 1/1975 Cooper ..... E21D 11/083 405/152
3,946,567 A * 3/1976 Oger ..... E21D 11/15 405/153
3,961,411 A * 6/1976 Oger ..... E21D 11/15 29/283
4,124,985 A * 11/1978 Maimets ..... E21D 11/08 405/150.1
4,150,175 A * 4/1979 Huettemann ..... E04C 2/044 427/209
4,657,435 A * 4/1987 Chang ..... E02D 29/063 405/136
4,683,156 A * 7/1987 Waters ..... E02B 3/123 405/19
6,328,501 B1 * 12/2001 Gimbert ..... E21D 11/08 285/293.1
6,554,536 B1 * 4/2003 Florence ..... F16L 55/1657 264/256
2003/0116210 A1 * 6/2003 Ishikawa ..... F16L 55/165 138/97
2003/0209821 A1 * 11/2003 Schmaltz, Jr. ..... E04G 21/185 264/32
2004/0104498 A1 * 6/2004 Schneider ..... B28B 23/0068 264/31
2004/0221529 A1 * 11/2004 Zornes ..... E04B 1/14 52/311.1
2007/0045508 A1 * 3/2007 Loeffler-Lenz ..... E04G 15/063 249/144
2007/0110989 A1 * 5/2007 Shin ..... C04B 33/04 428/312.2
2008/0092731 A1 * 4/2008 Hall ..... F42D 5/045 89/36.04
2008/0145580 A1 * 6/2008 McAllister ..... B32B 25/00 428/36.4
2008/0298903 A1 * 12/2008 Kim ..... E21D 11/08 405/288
2008/0307744 A1 * 12/2008 Kim ..... E04G 23/0233 52/742.14
2010/0139799 A1 * 6/2010 Kamiyama ..... F16L 55/1651 138/98
2010/0236179 A1 * 9/2010 Kim ..... E04B 2/42 52/578
2011/0011008 A1 * 1/2011 Dagher ..... B29C 33/505 52/2.15
2013/0279983 A1 * 10/2013 Benton, Jr. ..... B28B 7/0064 405/20
2015/0211230 A1 * 7/2015 Jimenez Horwitz ..... E04G 23/0296 52/426
2016/0138239 A1 * 5/2016 Lvarez Grac A-Luben ..... E02D 25/00 405/13

OTHER PUBLICATIONS

Contech Engineered Solutions, "2-Flange Tunnel Liner Plate Design Guide", 2017, pp. 1-20, 2nd Edition.

* cited by examiner

UNDERGROUND SUPPORT

CROSS-REFERENCE TO RELATED APPLICATION

This application claims the benefit of U.S. Provisional Patent Application No. 62/772,899, filed on Nov. 29, 2018, which is hereby incorporated by reference in its entirety.

BACKGROUND OF THE INVENTION

Field of the Invention

The present invention relates to an underground support and a method of installing an underground support.

Description of Related Art

Certain underground mines utilize a room and pillar mining technique where pillars of material are left to support the roof overburden while other material is removed to form the rooms. In underground stone or aggregate mining, the pillar dimensions are typically smaller than those in a coal mine due to the strength of the material forming the pillars and roof of the mine. As the size of the pillars is reduced, such as 40 feet wide rooms and cross cut width with 40 feet by 40 feet pillar dimensions, to increase recovery percentages and maximize profit and productivity, the stability of the pillars can be affected. In large mining districts, with a width of 3,000 feet and a length of 1,000 feet, the interior pillars in the mining district can begin to punch into the main roof beam due to pillar instability, pillar pre-failure due to aggressive scaling activities, and weathering due to changes in mine air humidity and temperature, causing reduction in the original pillar dimension of 40 feet by 40 feet down to 30 feet.

When these premature signs of failure occur in mining areas that are 23 feet high, there are currently very few options for standing support. In certain cases, attempts are made to backfill the premature fail areas with waste materials, which can cause the working areas to be inaccessible for escapeway or other activities that include travel through the area with trucks. In certain mines, the initial mining height is typically 23 feet to 25 feet.

SUMMARY OF THE INVENTION

In one aspect or embodiment, an underground support includes a first row of panels, and a second row of panels configured to be secured to the first row of panels to define an interior space for receiving construction aggregate or concrete. Each panel of the first row of panels and the second row of panels includes a body having a top edge, a bottom edge positioned opposite from the top edge, a left edge, and a right edge positioned opposite from the left edge, with the top edges of the panels of the first row of panels configured to abut the bottom edges of the panels of the second row of panels.

Each of the panels of the first row of panels and the second row of panels may include a concave face and a convex face positioned opposite from the concave face. The first row of panels and the second row of panels may be configured to form a circular column structure. Each of the panels of the first row of panels and the second row of panels may include a top flange, a bottom flange, a left flange, and a right flange. The top flange, the bottom flange, the left flange, and the right flange of each panel of the first and second rows of panels may extend radially outward from the body of each panel. The top flange, the bottom flange, the left flange, and the right flange of each panel of the first and second rows of panels may extend from the respective top edge, bottom edge, left edge, and right edge of each panel. The top flange, the bottom flange, the left flange, and the right flange of each panel of the first and second rows of panels may each define an opening configured to receive a fastener.

Each of the panels of the first row of panels and the second row of panels may include a handle extending radially outward from the body of each panel. The first row of panels and the second row of panels may be positioned in a running bond pattern. The first row of panels may have a first height and the second row of panels may have a second height, with the first height being different than the second height. The underground support may include a third row of panels, a fourth row of panels, a fifth row of panels, a sixth row of panels, and a seventh row of panels, where the third row of panels, the fourth row of panels, the fifth row of panels, the sixth row of panels, and the seventh row of panels each have an equal height. The first row of panels may include eight panels and the second row of panels may include eight panels.

The first row of panels and the second row of panels may be configured to form a polygonal column structure.

The underground support may further include a reinforcement ring configured to extend circumferentially around the first row of panels or the second row of panels.

The underground support may further include a reinforcement cage including a plurality of rebar supports. The reinforcement cage may be configured to abut an inner surface defined by the first and second rows of panels.

In a further aspect or embodiment, a method of installing an underground support includes: positioning a plurality of panels to form a first row of panels with each panel of the first row of panels secured to an adjacent panel of the first row of panels; positioning a plurality of panels to form a second row of panels with each panel of the second row of panels secured to an adjacent panel of the second row of panels; securing the first row of panels to the second row of panels with the first and second rows of panels defining an interior space; and positioning at least one of construction aggregate and concrete within the interior space.

Securing the first row of panels to the second row of panels may form a circular column structure. Each of the panels of the first row of panels and the second row of panels may include a top flange, a bottom flange, a left flange, and a right flange, where securing the first row of panels to the second row of panels may include positioning a plurality of fasteners through respective openings defined by the bottom flanges of the panels of the first row of panels and the top flanges of the panels of the second row of panels. Each panel of the first row of panels may be secured to an adjacent panel of the first row of panels by positioning a plurality of fasteners through respective openings defined by the left flanges and the right flanges of the panels of the first row of panels, where each panel of the second row of panels may be secured to an adjacent panel of the second row of panels by positioning a plurality of fasteners through respective openings defined by the left flanges and the right flanges of the panels of the second row of panels.

The method may include positioning the first row of panels and the second row of panels in a running bond pattern.

The method may include, removing the first and second rows of panels after positioning concrete within the interior space.

DETAILED DESCRIPTION

Figure 1:
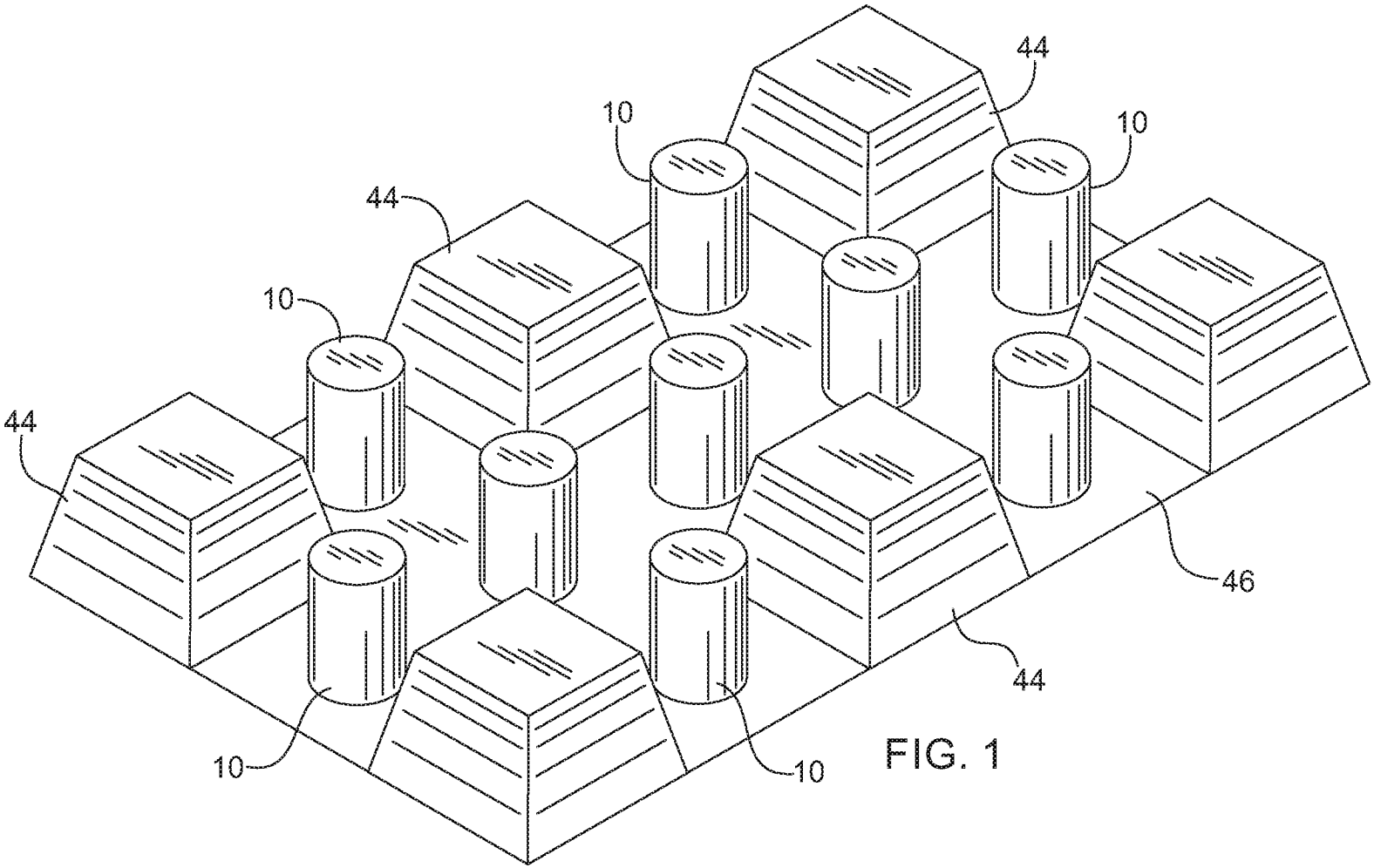
FIG. 1 is a top perspective view of an underground mine with a plurality of underground supports according to one aspect of the present application.

The following description is provided to enable those skilled in the art to make and use the described aspects contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations, except where expressly specified to the contrary. It is also to be understood that the specific devices illustrated in the attached drawings, and described in the following specification, are simply exemplary aspects of the invention. Hence, specific dimensions and other physical characteristics related to the aspects disclosed herein are not to be considered as limiting.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

As used herein, "at least one of" is synonymous with "one or more of". For example, the phrase "at least one of A, B, and C" means any one of A, B, or C, or any combination of any two or more of A, B, or C. For example, "at least one of A, B, and C" includes one or more of A alone; or one or more B alone; or one or more of C alone; or one or more of A and one or more of B; or one or more of A and one or more of C; or one or more of B and one or more of C; or one or more of all of A, B, and C.

Referring to FIGS. 1-10, an underground support 10 includes a first row of panels 12 and a second row of panels 14 configured to be secured to the first row of panels 12 to define an interior space 16 for receiving construction aggregate or concrete 18. The construction aggregate or concrete 18 may be aggregate waste rock or 4,000 psi concrete and rebar arrangement, although other suitable aggregates and concrete may be utilized. As shown more clearly in FIG. 9, the underground support 10 also includes a third row of panels 20, a fourth row of panels 22, a fifth row of panels 24, a sixth row of panels 26, and a seventh row of panels 28, although one or rows of panels may be utilized as suitable. Each panel 30 of the first row of panels 12 and the second row of panels 14 includes a body 32 having a top edge 34, a bottom edge 36 positioned opposite from the top edge 34, a left edge 38, and a right edge 40 positioned opposite from the left edge 38. The top edges 34 of the panels 30 of the first row of panels 12 are configured to abut the bottom edges 36 of the panels 30 of the second row of panels 14. Each of the panels 30 is curved, although other suitable arrangements may be utilized. As discussed in more detail below, the underground support 10 is for supporting a roof 42 of an underground mine.

Figure 2:
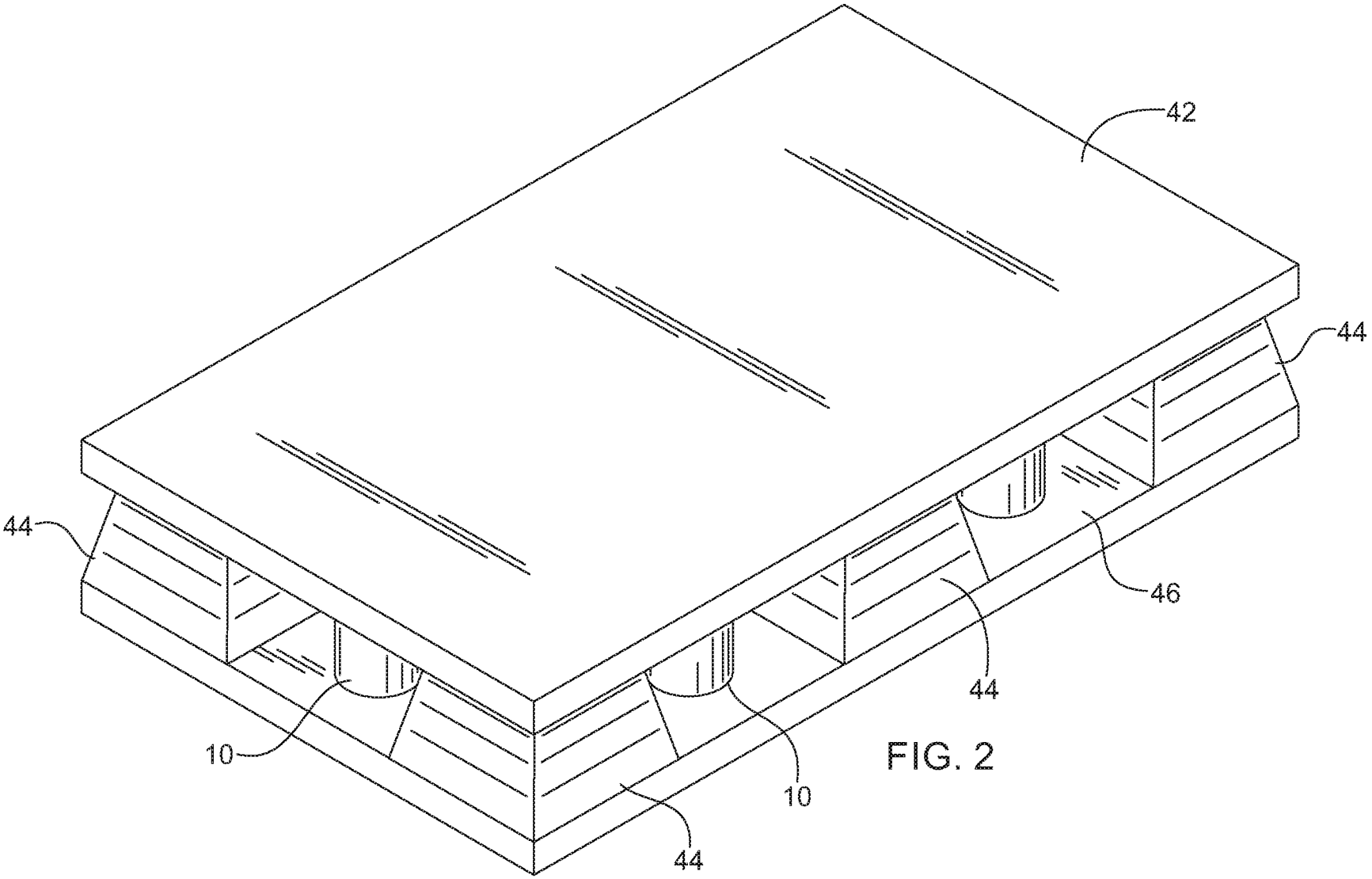
FIG. 2 is a perspective view of the underground mine of FIG. 1.
Figure 3:
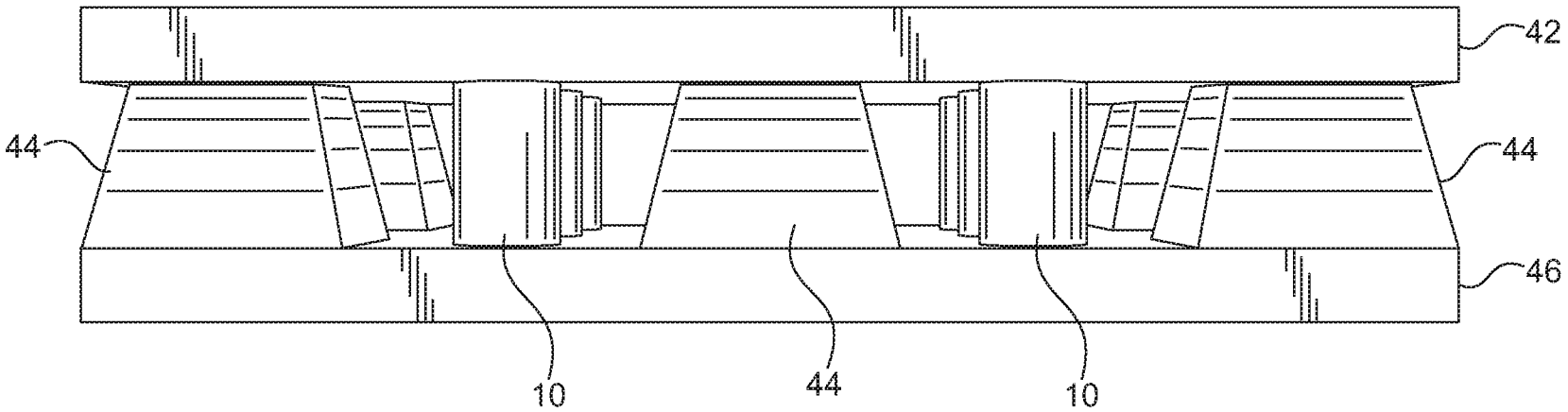
FIG. 3 is a front perspective view of the underground mine of FIG. 1.
Figure 4:
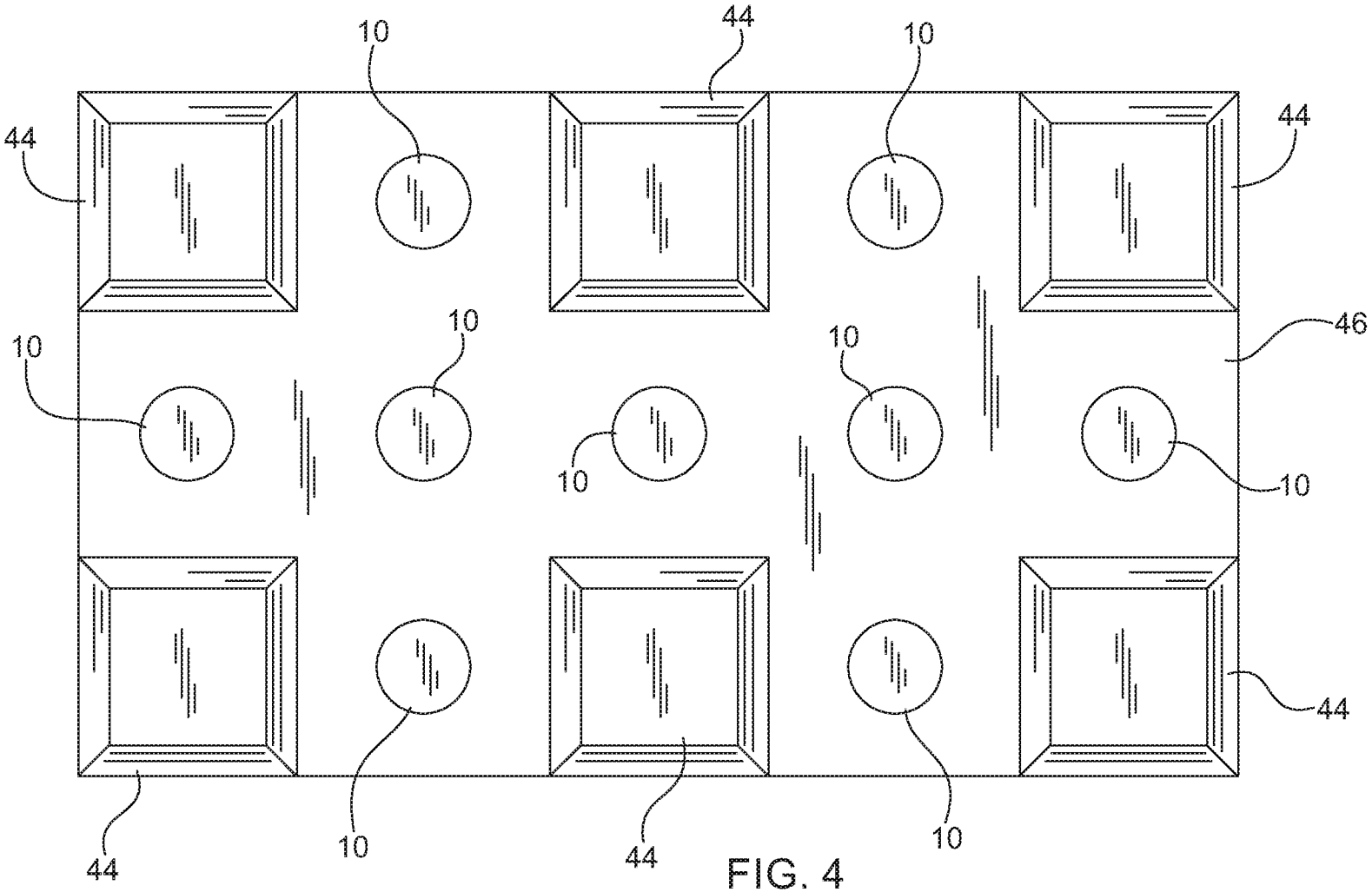
FIG. 4 is a top view of the underground mine of FIG. 1.
Figure 5:
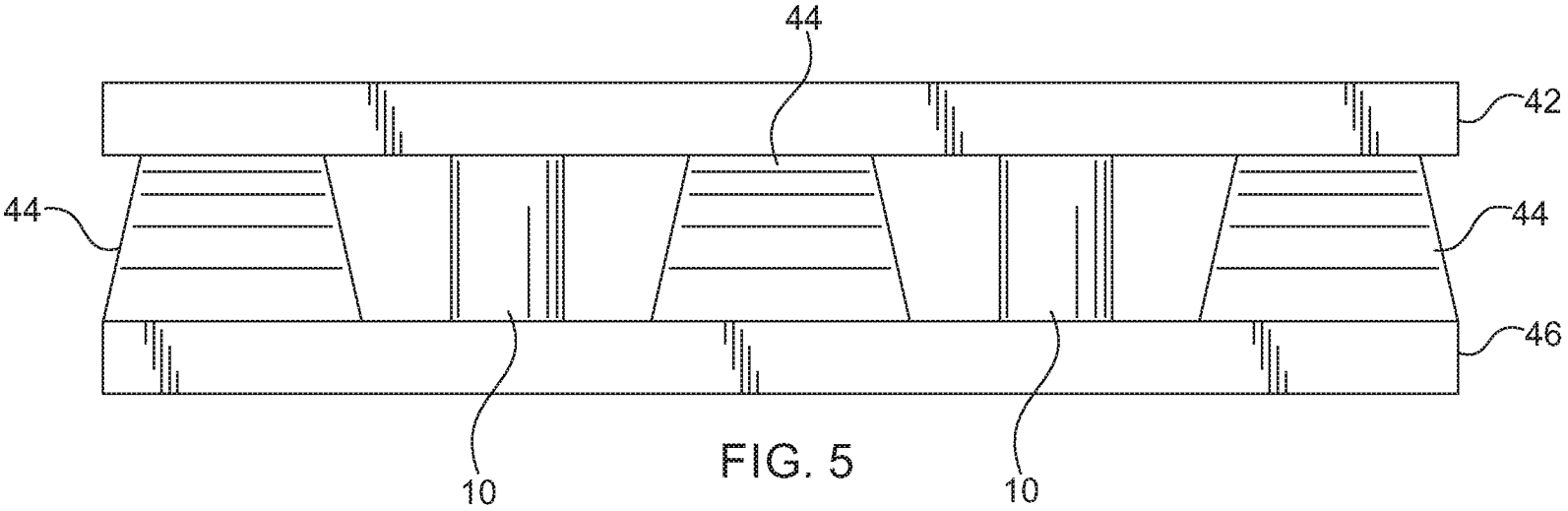
FIG. 5 is a front view of the underground mine of FIG. 1.

Referring to FIGS. 1-5, a plurality of the underground supports 10 may be provided between pillars 44 of the underground mine and extend between a floor 46 and the roof 42 of the underground mine opening. As the pillars 44 deteriorate and slough at the top, as shown in FIGS. 1-3, the underground supports 10 are installed to stabilize the area and further support the weakened pillars 44.

Referring to FIGS. 6-10, each of the panels 30 includes concave face 48 and a convex face 50 positioned opposite from the concave face 48. The rows of panels 12, 14, 20, 22, 24, 26, 28 are configured to form a circular column structure. In one aspect or embodiment, the rows of panels 12, 14, 20, 22, 24, 26, 28 form a 15' diameter by 23' high circular column structure, although other suitable dimensions and shapes may be utilized. Each of the panels 30 includes a top flange 52, a bottom flange 54, a left flange 56, and a right flange 58. The top flange 52, the bottom flange 54, the left flange 56, and the right flange 58 of each panel 30 extends radially outward from the body 32 of each panel 30, which allows an installer to assemble the underground support 10 from an exterior of the underground support 10. The top flange 52, the bottom flange 54, the left flange 56, and the right flange 58 of each panel 30 extends from the respective top edge 34, bottom edge 36, left edge 38, and right edge 40 of each panel 30, although other suitable arrangements may be utilized. Certain panels 30, such as the panels 30 of the third, fourth, fifth, sixth, and seventh rows of panels 20, 22, 24, 26, 28, may further include an intermediate support 60 extending between the left flange 56 and the right flange 58, which acts to stiffen the panel 30.

Figure 6:
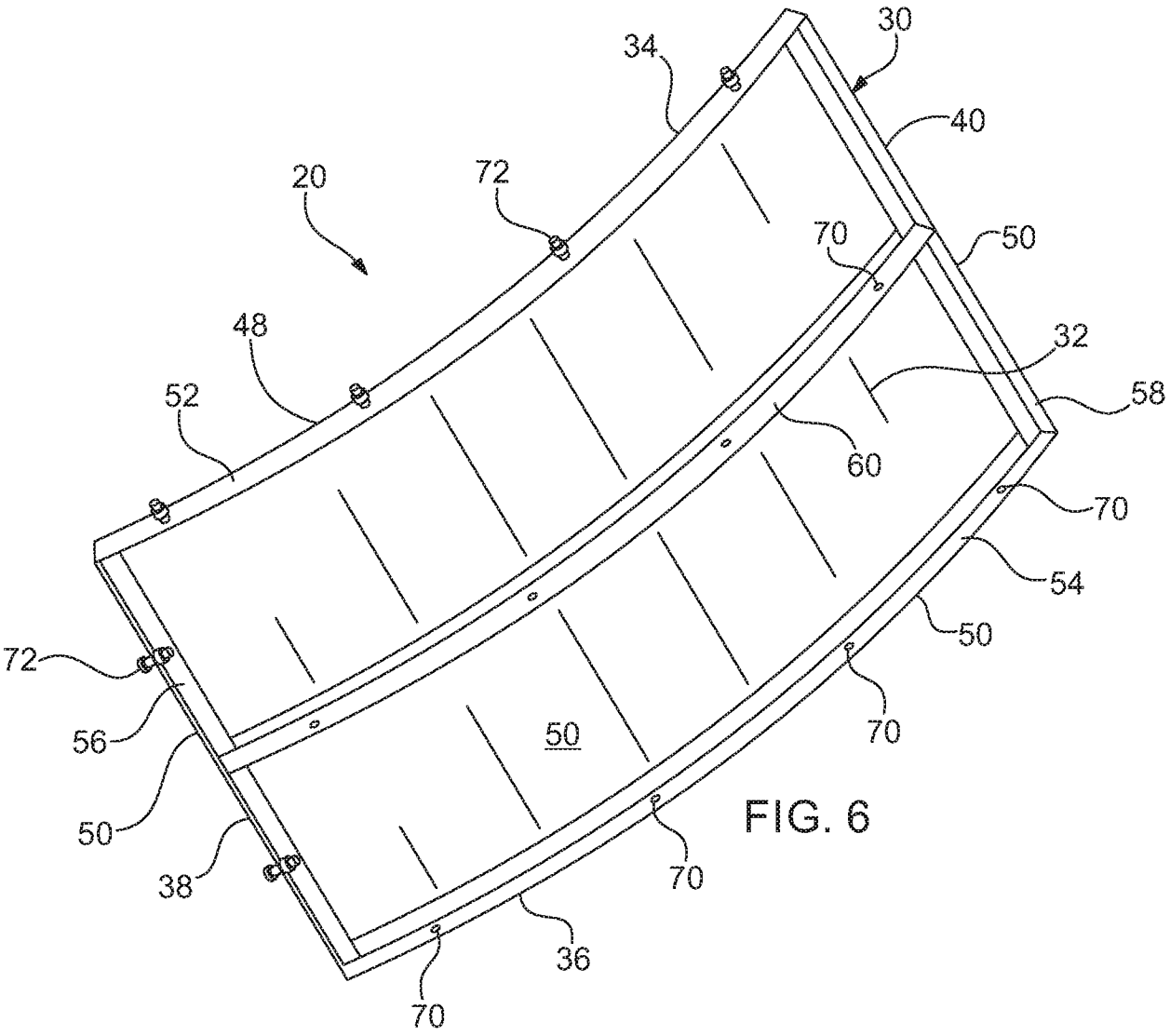
FIG. 6 is a perspective view of a panel of an underground support according to one aspect of the present application.
Figure 10:
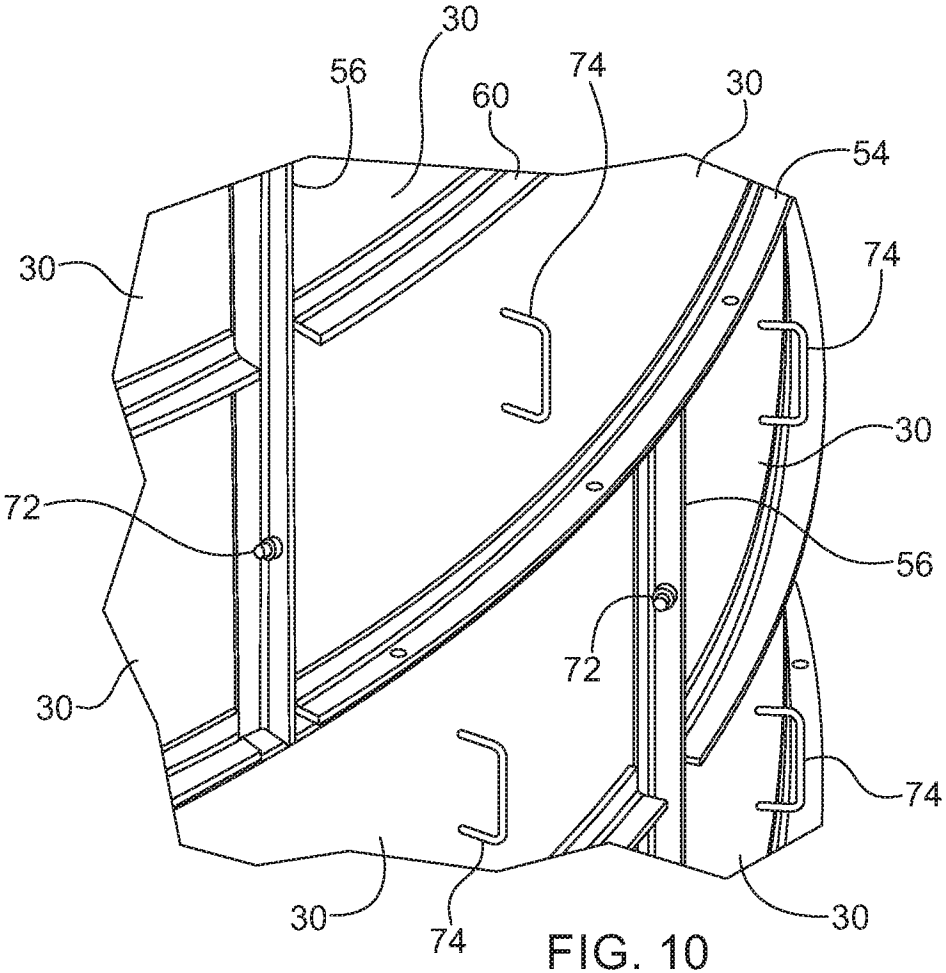
FIG. 10 is a detailed view of the underground support of FIG. 7.

Referring to FIGS. 6 and 10, the top flange 52, the bottom flange 54, the left flange 56, and the right flange 58 of each panel 30 define an opening 70 configured to receive a fastener 72. The fastener 72 may be a bolt and nut, although other suitable fastener arrangements, such as welding, riveting, clamping, etc., may be utilized. Each of the panels 30 includes a handle 74 extending radially outward from the body 32 of each panel 30. The handle 74 is U-shaped, although other suitable shapes and configurations for the handle 74 may be utilized. The handle 74 is configured to be grasped by an installer to facilitate the positioning and installation of the panels 30 to form the underground support 10.

Figure 9:
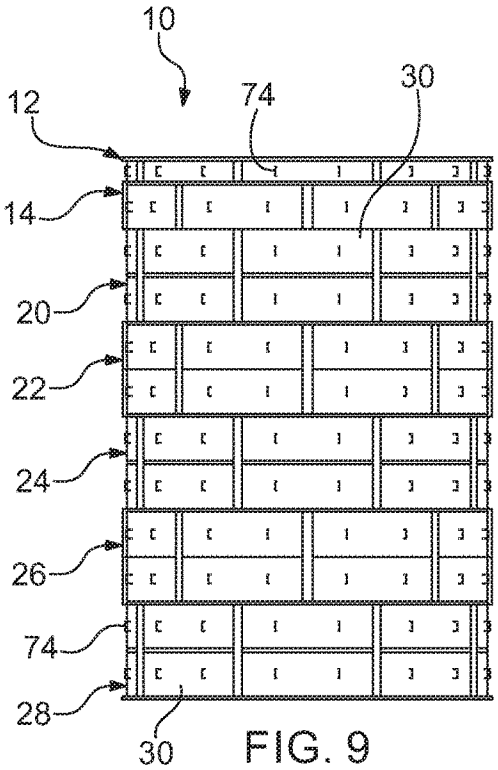
FIG. 9 is a front view of the underground support of FIG. 7.
Figure 8:
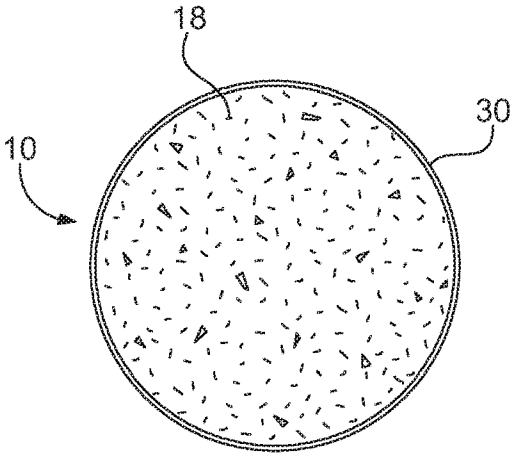
FIG. 8 is a top view of the underground support of FIG. 7.
Figure 7:
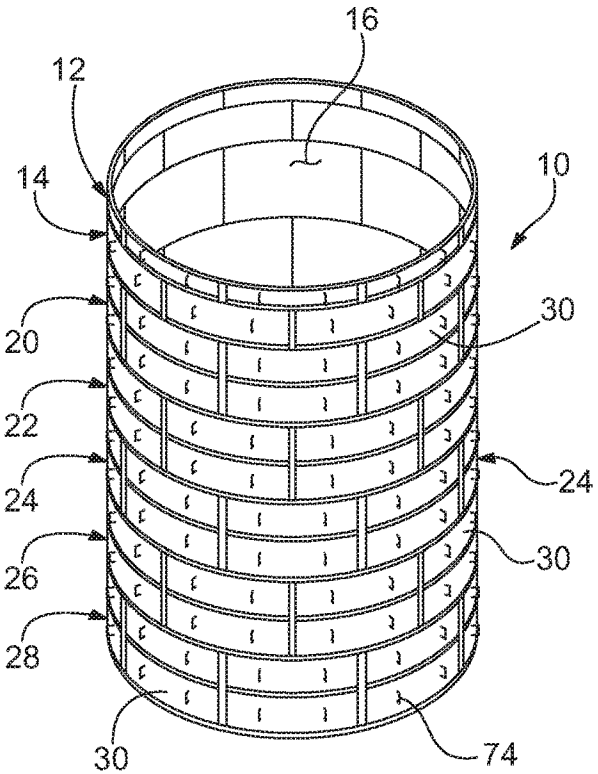
FIG. 7 is a perspective view of underground support according to one aspect of the present application

Referring to FIGS. 7 and 9, the rows of panels 12, 14, 20, 22, 24, 26, 28 are positioned in a running bond pattern, although other suitable patterns may be utilized. The first row of panels 12 has a first height and the second row of panels 14 has a second height, with the first height being different than the second height. The first row 12 may be half the height of the second row 14. The third row of panels 20, the fourth row of panels 22, the fifth row of panels 24, the sixth row of panels 26, and the seventh row of panels 28 each have an equal height. The height of the third row of panels 20, the fourth row of panels 22, the fifth row of panels 24, the sixth row of panels 26, and the seventh row of panels 28 may be twice the height of the second row of panels 14. Each row of panels 12, 14, 20, 22, 24, 26, 28 includes eight panels 30, although other suitable arrangements may be utilized. As noted above, each panel 30 is curved such that adding additional panels 30 to each row of panels 12, 14, 20, 22, 24, 26, 28 will increase the diameter of the underground support 10.

Figure 11:
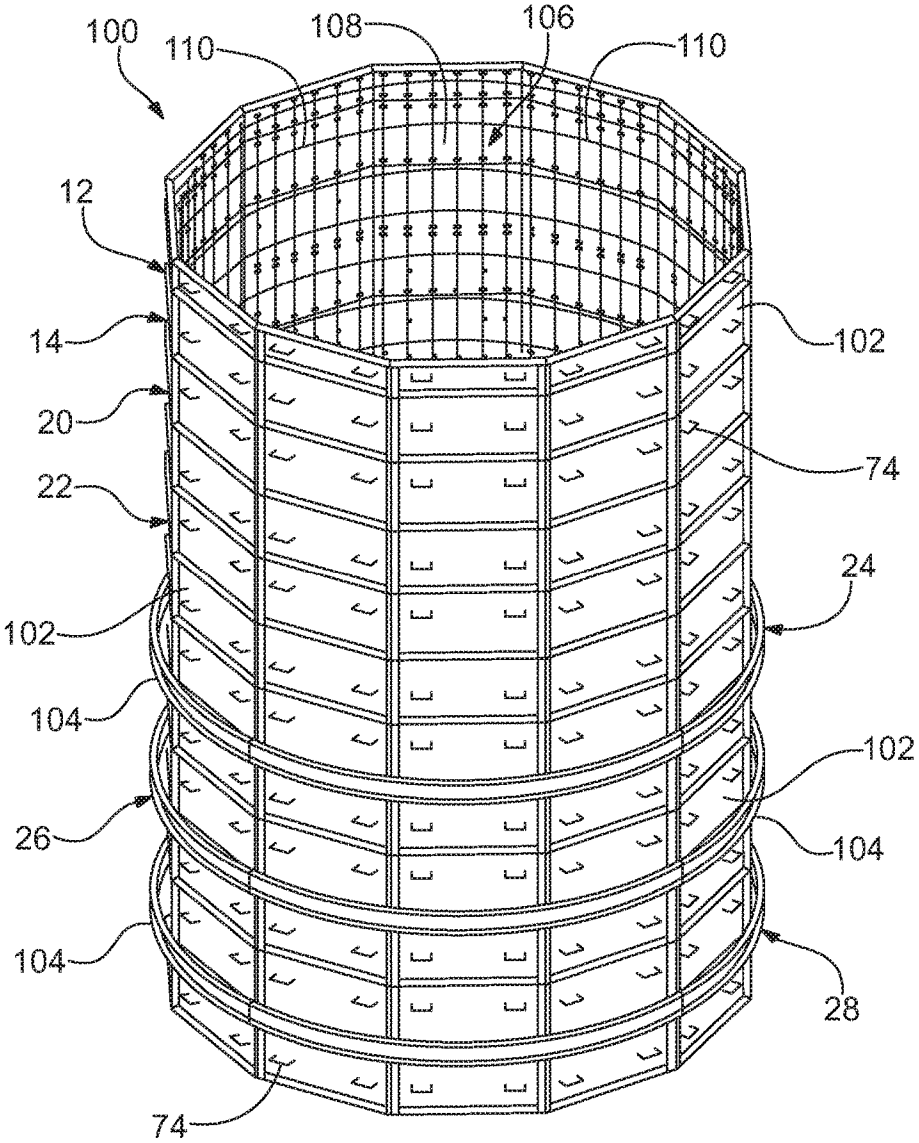
FIG. 11 is a perspective view of an underground support according to a further aspect of the present application.

Referring to FIG. 11, an underground support 100 according to a further aspect or embodiment of the present application is similar to the underground support 10 discussed above in connection with FIGS. 1-10. Rather than forming a circular column structure, however, the underground support 100 forms a polygonal column structure formed from a plurality of panels 102 that are flat rather than curved as with the panels 30 discussed above. The underground support 100 also includes reinforcement rings 104 extending circumferentially around the underground support 100. Although three reinforcement rings 104 are shown, one or more reinforcement rings 104 may be provided. The reinforcement rings 104 are configured to reinforce the panels 104 and resist radial deflection of the underground support 100. The reinforcement ring 104 may be formed from a curved, U-shaped channel, although other suitable shapes and configurations may be utilized. The underground support also includes a reinforcement cage 106 positioned along and/or abutting an inner surface 108 of the panels 102 forming the underground support 100. The reinforcement cage 106 may be formed from a plurality of rebar supports 110 extending vertically and horizontally. The rebar supports 110 may be secured to adjacent rebar supports 110 and may also be secured to the inner surface 108 of the panels 102 via any suitable fastener. The panels 102 may be secured to each other and function in the same manner as the panels 30 discussed above.

Although not shown, the underground support 10 may also include one or more reinforcement rings 104 and/or the reinforcement cage 106 shown in connection with the underground support 100 of FIG. 11.

Referring to FIGS. 1-11, according to a further aspect or embodiment of the present application, a method of installing an underground support, such as the underground supports 10, 100, includes: positioning a plurality of panels 30,102 to form the first row of panels 12 with each panel 30,102 of the first row of panels 12 secured to an adjacent panel of the first row of panels 12; positioning a plurality of panels 30,102 to form the second row of panels 14 with each panel 30 of the second row of panels 14 secured to an adjacent panel of the second row of panels 14; securing the first row of panels 12 to the second row of panels 14 with the first and second rows of panels 12,14 defining the interior space 16; and positioning at least one of construction aggregate and concrete 18 within the interior space 16.

Securing the first row of panels 12 to the second row of panels 14 includes positioning a plurality of fasteners 72 through respective openings 70 defined by the bottom flanges 54 of the panels 30,102 of the first row of panels 12 and the top flanges 52 of the panels 30,102 of the second row of panels 14, although other suitable arrangements may be utilized. Each panel 30,102 of the first row of panels 12 is secured to an adjacent panel of the first row of panels 12 by positioning a plurality of fasteners 72 through respective openings 70 defined by the left flanges 56 and the right flanges 58 of the panels 30,102 of the first row of panels 12, although other suitable arrangements may be utilized. Each panel 30,120 of the second row of panels 14 is secured to an adjacent panel of the second row of panels 14 by positioning a plurality of fasteners 72 through respective openings 70 defined by the left flanges 56 and the right flanges 58 of the panels 30,102 of the second row of panels 14, although other suitable arrangements may be utilized. The third, fourth, fifth, sixth, and seventh rows of panels 20, 22, 24, 26, 28 may be assembled and connected to adjacent rows in the same manner as discussed above in connection with the first and second rows of panels 12,14. As noted above, the fasteners 72 may be a bolt and nut arrangement, welding, rivets, clamping, or any other suitable arrangement.

The underground supports 10,100 may be filled with construction aggregate 18, such as aggregate waste rock, and capped with concrete, such as 4,000 psi concrete, to the roof of the underground mine. Alternatively, the underground support may act as a form for concrete 18, such as 4,000 psi concrete. A prefabricated rebar column (not shown) may be inserted into the underground support 10 formed by the panels 30,102 prior to installation of the concrete 18. After the concrete structure has set, the panels 30,102 may be removed and reused again to produce additional concrete structures.

In one aspect or embodiment of the present application, the panels 30,120 are tunnel lining panels, although other suitable panel arrangements may be utilized. In one aspect or embodiment, the panels 30,102 are two-flange tunnel lining panels available from Jennmar Civil. In another aspect or embodiment, the panels 30,102 are two-flange panels or MULTI-PLATE® panels available from Contech Engineered Solutions.

While this disclosure has been described as having exemplary designs, the present disclosure can be further modified within the spirit and scope of this disclosure. This application is therefore intended to cover any variations, uses, or adaptations of the disclosure using its general principles. To the extent possible, one or more features of any embodiment or aspect can be combined with one or more features of any other embodiment or aspect. Further, this application is intended to cover such departures from the present disclosure as come within known or customary practice in the art to which this disclosure pertains and which fall within the limits of the appended claims.

The invention claimed is:

1. An underground support for supporting an underground opening between a floor and a roof of the underground opening, the underground support comprising:

a first row of panels; and a second row of panels configured to be secured to the first row of panels to define an interior space for receiving construction aggregate or concrete, wherein each panel of the first row of panels and the second row of panels comprises a body having a top edge, a bottom edge positioned opposite from the top edge, a left edge, and a right edge positioned opposite from the left edge, the top edges of the panels of the first row of panels configured to abut the bottom edges of the panels of the second row of panels, wherein the panels of the first row of panels are separate from each other, with the right edge of each panel of the first row of panels configured to be secured to the left edge of an adjacent panel of the first row of panels, wherein the panels of the second row of panels are separate from each other, with the right edge of each panel of the second row of panels configured to be secured to the left edge of an adjacent panel of the second row of panels, the first row of panels and the second row of panels defining a circumference of the interior space, and wherein, when the first row of panels is secured to the second row of panels to form the underground support, the underground support is configured to extend between and engage the floor and the roof of the underground opening and support the roof of the underground opening.

2. The underground support of claim 1, wherein each of the panels of the first row of panels and the second row of panels comprise a concave face and a convex face positioned opposite from the concave face.

3. The underground support of claim 2, wherein the first row of panels and the second row of panels are configured to form a circular column structure.

4. The underground support of claim 1, wherein each of the panels of the first row of panels and the second row of panels comprise a top flange, a bottom flange, a left flange, and a right flange.

5. The underground support of claim 4, wherein the top flange, the bottom flange, the left flange, and the right flange of each panel of the first and second rows of panels extend radially outward from the body of each panel.

6. The underground support of claim 4, wherein the top flange, the bottom flange, the left flange, and the right flange of each panel of the first and second rows of panels extend from the respective top edge, bottom edge, left edge, and right edge of each panel.

7. The underground support of claim 4, wherein the top flange, the bottom flange, the left flange, and the right flange of each panel of the first and second rows of panels each define an opening configured to receive a fastener.

8. The underground support of claim 1, wherein each of the panels of the first row of panels and the second row of panels comprise a handle extending radially outward from the body of each panel.

9. The underground support of claim 1, wherein the first row of panels and the second row of panels are positioned in a running bond pattern.

10. The underground support of claim 1, wherein the first row of panels has a first height and the second row of panels has a second height, the first height being different than the second height.

11. The underground support of claim 10, further comprising a third row of panels, a fourth row of panels, a fifth row of panels, a sixth row of panels, and a seventh row of panels, wherein the third row of panels, the fourth row of panels, the fifth row of panels, the sixth row of panels, and the seventh row of panels each have an equal height.

12. The underground support of claim 1, wherein the first row of panels includes eight panels and the second row of panels includes eight panels.

13. The underground support of claim 1, wherein the first row of panels and the second row of panels are configured to form a polygonal column structure.

14. The underground support of claim 1, further comprising a reinforcement ring configured to extend circumferentially around the first row of panels or the second row of panels.

15. The underground support of claim 1, further comprising a reinforcement cage including a plurality of rebar supports.

16. A method of installing an underground support for supporting an underground opening between a floor and a roof of the underground opening, the method comprising:

positioning a plurality of panels to form a first row of panels with each panel of the first row of panels secured to an adjacent panel of the first row of panels;

positioning a plurality of panels to form a second row of panels with each panel of the second row of panels secured to an adjacent panel of the second row of panels;

securing the first row of panels to the second row of panels with the first and second rows of panels defining an interior space, wherein each panel of the first row of panels and the second row of panels comprises a body having a top edge, a bottom edge positioned opposite from the top edge, a left edge, and a right edge positioned opposite from the left edge, the top edges of the panels of the first row of panels configured to abut the bottom edges of the panels of the second row of panels, wherein the panels of the first row of panels are separate from each other, with the right edge of each panel of the first row of panels configured to be secured to the left edge of an adjacent panel of the first row of panels, wherein the panels of the second row of panels are separate from each other, with the right edge of each panel of the second row of panels configured to be secured to the left edge of an adjacent panel of the second row of panels, the first row of panels and the second row of panels defining a circumference of the interior space; and positioning at least one of construction aggregate and concrete within the interior space to stabilize the underground opening and support the underground opening between the floor and the roof of the underground opening, wherein, when the first row of panels is secured to the second row of panels to form the underground support, the underground support extends between and engages the floor and the roof of the underground opening.

17. The method of claim 16, wherein each of the panels of the first row of panels and the second row of panels comprise a top flange, a bottom flange, a left flange, and a right flange, and wherein securing the first row of panels to the second row of panels comprises positioning a plurality of fasteners through respective openings defined by the bottom flanges of the panels of the first row of panels and the top flanges of the panels of the second row of panels.

18. The method of claim 17, wherein each panel of the first row of panels is secured to an adjacent panel of the first row of panels by positioning a plurality of fasteners through respective openings defined by the left flanges and the right flanges of the panels of the first row of panels, and wherein each panel of the second row of panels is secured to an adjacent panel of the second row of panels by positioning a plurality of fasteners through respective openings defined by the left flanges and the right flanges of the panels of the second row of panels.

19. The method of claim 16, further comprising:

positioning the first row of panels and the second row of panels in a running bond pattern.

20. The method of claim 16, after positioning concrete within the interior space, removing the first and second rows of panels.

* * * * *